US005930567A

United States Patent [19]

Agano

[11] Patent Number: 5,930,567

[45] Date of Patent: Jul. 27, 1999

[54] IMAGE RECORDING METHOD FOR FORMING TONER IMAGES OF THE SAME COLOR

[75] Inventor: Toshitaka Agano, Kanagawa, Japan

[73] Assignee: Fuji Photo Film Co., Ltd., Kanagawa, Japan

[21] Appl. No.: 08/958,445

[22] Filed: Oct. 27, 1997

[30] Foreign Application Priority Data

Oct. 29, 1996 [JP] Japan ..... 8-286573

[51] Int. Cl.[6] ..... G03G 15/01; G03G 13/01

[52] U.S. Cl. ..... 399/223; 430/54

[58] Field of Search ..... 399/145, 223; 430/54

[56] References Cited

U.S. PATENT DOCUMENTS 2,868,642 1/1959 Hayford et al. ..... 430/54

3,960,444 6/1976 Gundlach et al. ..... 399/223 X 4,927,725 5/1990 Nishide et al. ..... 430/54

5,363,178 11/1994 Matsumoto ..... 399/223 X

*Primary Examiner*—Fred L. Braun

*Attorney, Agent, or Firm*—Sughrue, Mion, Zinn, Macpeak & Seas, PLLC

[57] ABSTRACT

In an image recording method, toner images of the same color are electrographically formed in superposition onto a recording medium. The recording medium is paper, film, or the like. Each toner image is formed of toner particles. Particles having different sizes or optical densities may be used in different toner images. No wet system processing is involved. The image recording apparatus employing the method may have one or more drums on which latent images are formed. The latent images may be identical or may be varied based on the image density.

15 Claims, 3 Drawing Sheets

IMAGE RECORDING METHOD FOR FORMING TONER IMAGES OF THE SAME COLOR

BACKGROUND OF THE INVENTION

This invention relates to a method of recording high contrast (gradient) and density images reproduced by electrophotography.

Conventional radiography intended for use in medical diagnoses is performed by either the X-ray photographic process in which a radiation image is directly exposed on an X-ray film or by a radiation image information record/reproduce system in which an image exposed on a stimulable phosphor sheet is read photoelectrically and appropriately processed to provide a reproduction on a CRT, the X-ray film or a photographic film. Both approaches have achieved marked results. In other systems such as CT and MR which produce images for use in medical fields, images for use in medical diagnosis are reproduced on photographic films to provide hard copies. Other images in hard copy that are currently employed for diagnosis in research or engineering fields include the electron microscope image produced from an electron microscopic image record/reproduce system using a stimulable phosphor sheet, as well as a probe image from a radiation probe system employed in the nondestructive inspection of buildings and other structures.

Such images for use in diagnoses, particularly in medical diagnoses, are required to have high image quality, namely, high density, high resolution and high contrast or multiple gradations. This need has heretofore been met by a wet system, in which an exposed silver salt photographic material is wet processed to provide image reproduction. The wet system is capable of reproducing a high-quality image but, on the other hand, it is not simple to use because of the need to employ processing solutions such as developing and fixing baths. Under the circumstances, a growing interest is emerging in the field of image recording by a dry system which involves no wet processing.

A commercially feasible dry system for image recording is by electrophotography, which comprises the basic steps of imagewise exposure of an electrophotographic photoreceptor to form a latent image, developing the latent image with a toner to form a visible image and transferring the toner image on to a final image support such as a paper or a film, thereby obtaining the transferred toner image in hard copy.

In electrophotography, the reproduced monochromatic image is formed of the toner particles transferred on to the support and its contrast is represented by two areas of the support, one to which the toner has been transferred and the other where it has not been transferred. Hence, the degree of contrast that can be achieved in the recording of a reproduced image by one cycle of exposure, development and transfer steps using a monochromatic toner is limited and irrespective of whether the support is of a reflection type such as paper or of a transmission type such as a film, the degree of contrast that is required by images for use in diagnoses, particularly in medical diagnoses, which should be at least comparable to 10 bits (1024 levels of the gradient) cannot be attained.

A further problem with such one-pass image recording involving only one cycle of exposure, development and transfer steps is a limited amount of transfer that can be effected at a time and the attainable maximal density is lowered, even becoming insufficient when using a transmission support. In order for a given image to have sufficiently high quality that it is suitable for use in medical diagnosis, a maximal density of about 3.0 is necessary but this need can hardly be met by one-pass image recording and the quality of the resulting image is far from being satisfactory.

SUMMARY OF THE INVENTION

The present invention has been accomplished under these circumstances and has as an object providing an electrophotographic method by which high-quality images having high density ($D_{max}$) and high contrast can be reproduced not only on reflection-type supports such as paper but also on transmission-type supports such as a film.

This object of the invention can be attained by an image recording method in which toner images of the same color are formed on an electrophotographic photoreceptor by electrophotography and transferred more than once in superposition on to a single image recording medium, thereby recording a single reproduced image.

Preferably, the toner images to be transferred more than once are formed on the basis of the same image data.

It is also preferred that the toner images to be transferred more than once are formed in accordance with the density of a specific area of the reproduced image.

It is further preferred that the toner images to be transferred more than once have different resolutions.

In yet another preferred embodiment, the toner images to be transferred more than once are formed of different sized toner particles.

In still another preferred embodiment, the toner images to be transferred more than once are formed of toner particles having different optical densities.

In other preferred embodiments, the toner images to be transferred more than once are either the images that are formed as latent images on the same electrophotographic photoreceptor with the same laser light and developed with the same toner, or the images that are formed as latent images on the same electrophotographic photoreceptor with the same laser light and developed with different toners, or the images that are formed as latent images on the same electrophotographic photoreceptor with different beams of laser light and developed with different toners, or the images that are formed as latent images on different electrophotographic photoreceptors with different beams of laser light and developed with different toners.

DETAILED DESCRIPTION OF THE INVENTION

The image recording method of the invention will now be described in detail with reference to the preferred embodiments shown in the accompanying drawings.

In accordance with the image recording method of the invention, toner images of the same color are formed on an electrophotographic photoreceptor, transferred more than once in superposition on to the same final image support and later fixed to provide a single reproduced image in hard copy.

In the first embodiment of the invention, the process of forming a latent image on a single electrophotographic photoreceptor with a single light beam and developing the latent image with a single kind of toner to form a visible image is repeated several times to produce a single image in hard copy, as described below.

Figure 1:
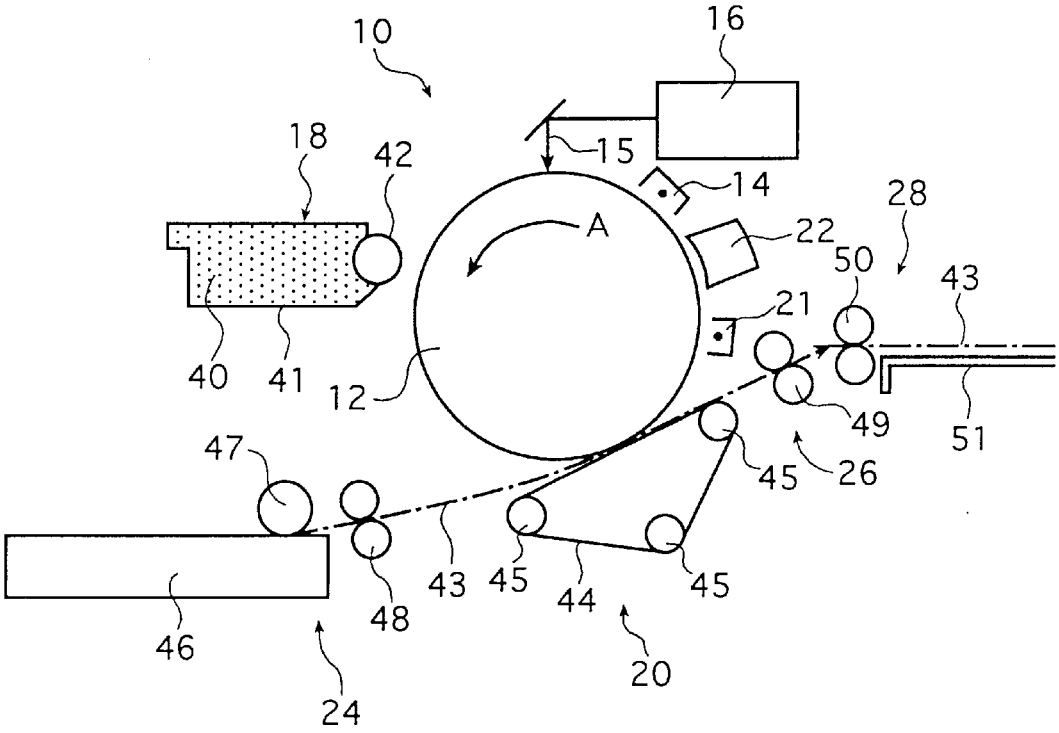
FIG. 1 is a simplified schematic view of an exemplary image recording apparatus for implementing the image recording method of the invention.

FIG. 1 is a simplified schematic view of an exemplary electrophotographic image recording apparatus for implementing the image recording method of the invention. The electrophotographic image recording apparatus (hereunder referred to simply as "electrophotographic apparatus") which is generally indicated by 10 in FIG. 1 comprises the following basic components, sections or means: an electrophotographic photoreceptor drum 12 (which is hereunder referred to simply as a "photoreceptor drum") which has a photoconductor layer provided on the outer circumference; means for forming a toner image on the outer circumference of the photoreceptor drum 12 rotating in the direction of arrow A, which comprises, in the direction A of the rotation of the photoreceptor drum 12 and spaced from its outer circumference, a corona charging device 14, exposing means 16, a toner developer 18, transfer means 20, an eraser 21 and cleaning means 22; a feed section 24 for supplying a final image support such as an image receiving paper or film to the transfer means 20; fixing means 26 for fixing the toner image as transferred onto the final image support; and an ejecting section 28 for ejecting the final image bearing support onto which the toner image has been fixed.

The photoreceptor drum 12 has a photoconductor layer on the outer circumference, which is uniformly charged by corona discharge created by the corona charging device 14 such that a latent image is formed by imagewise exposure to an exposing light beam; the latent image is developed with a toner to produce a toner image, which is subsequently transferred on to a suitable support such as an image receiving paper or film which is also wound onto the photoreceptor drum. Having these functions to perform, the photoreceptor should have the necessary sensitivity at the wavelength of the exposing light beam and it is preferably capable of long run. The photoconductor layer which forms the outer circumference of the photoreceptor drum 12 is made of materials including ZnS, CdS, Se alloys, OPC (organic photoconductor) and amorphous silicon carbide ($\alpha$-SiC).

The corona charging device 14 is supplied with an ultra-high voltage to produce corona discharge which uniformly charges the photoconductor layer on the outer circumference of the photoreceptor drum 12. A typical example of this device is a corotron which is composed of a shield plate, fine tungsten wire electrodes and, optionally, a grid preferably interposed between the set of tungsten wires and the photoreceptor drum 12.

The exposing means 16 supplies an image data modulated light beam to perform imagewise exposure of the outer circumference (the photoconductor layer on it) of the photoreceptor drum 12 uniformly charged with the corona charging device 14, whereby a latent image is formed on the outer circumference of the photoreceptor drum 12.

Figure 2:
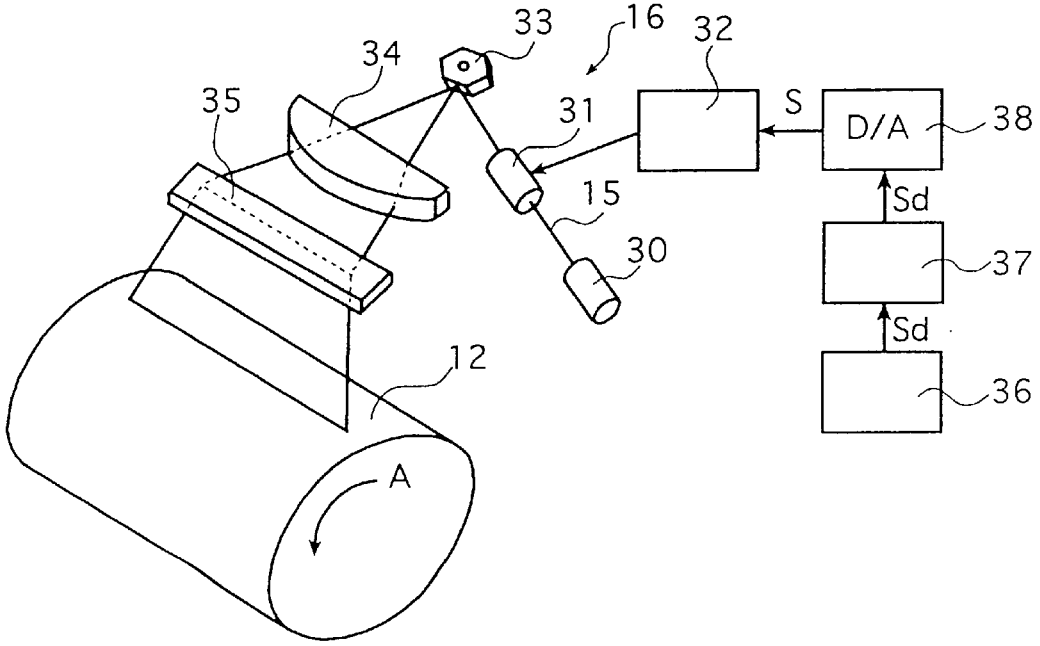
FIG. 2 is a schematic perspective view illustrating exemplary exposing means for use with the image recording apparatus shown in FIG. 1.

As typically shown in FIG. 2, the exposing means 16 comprises a laser light source 30 in the form of a semiconductor laser (LD), a gas laser or the like, an optical modulator 31 such as an AOM (acoust-optical modulator) for intensity modulating a light beam (laser beam) 15 issuing from the source 30, a modulator circuit 32 for driving the optical modulator 31, a light deflector 33 such as a polygonal mirror for reflecting and deflecting the modulated light beam 15 such that it scans the surface of the photoreceptor drum 12 in a direction which is parallel to the central axis through the drum 12 and which is generally perpendicular to the direction of its rotation (as indicated by arrow A), a scanning lens 34 which is an of lens for converging the deflected light beam 15 to a uniform beam size on the surface of the photoreceptor drum 12, and a bend-down mirror 35 for bending down the converged (focused) light beam 15 to fall on the photoreceptor drum 12.

The optical modulator 31 is connected to a D/A converter 38 via the modulator circuit 32 in accordance with the image recording method of the invention such that a digital image signal Sd delivered from an image signal processor 36 is corrected by a correction table 37 and converted to an analog image signal S by means of the D/A converter 38, on the basis of which the modulator circuit 32 generates a modulated analog signal SM for driving the optical modulator 31.

In the illustrated case, the light deflector 33 performs main scanning with the light beam 15 whereas auxiliary scanning is accomplished by rotating the photoreceptor drum 12 (in the direction of arrow A). However, this is not the sole case of the invention and the main scanning with the light beam 15 may be performed by the rotation of the photoreceptor drum 12 whereas the auxiliary scanning is effected by moving the photoreceptor drum 12 or the light source unit parallel to the central axis of the drum. If the light source unit is to be moved, the associated moving means is necessary but, on the other hand, there is no need to use the expensive light deflector 33 or scanning lens 34 or the elongated bend-down mirror 35 and the mere combination of an inexpensive small imaging lens and reflector mirror will suffice.

The method of modulating the light beam 15 also is not limited to the illustrated case of using the light modulator 31 and the laser light source 30 may be directly modulated. The method of modulation may be by pulse-amplitude modulation (PAM), pulse-width modulation (PWM) or pulse-numbers modulation (PNM).

In the illustrated case, the laser light source 30 is used as the exposing light source but this is not the sole case of the invention and any other light source such as a light-emitting diode (LED) or an LED array can be adopted as long as they are capable of imagewise exposure of the drum 12 to form a latent image on the photoreceptor. Needless to say, appropriate exposing optics should be employed in accordance with the specific exposing light source used.

The toner developer 18 is a device for performing toner development of the latent image formed on the surface of the photoreceptor drum 12 by the exposing means 16 and it comprises a container 41 of toner particles 40 and a developing roller 42 provided at the distal end of the toner container 41. The roller 42 which is provided in proximity with the outer circumference of the latent image carrying photoreceptor drum 12 is rotated such that toner particles 40 are picked up from within the container 41 to be deposited on the outer circumference of the roller 42 which, in turn, is brought close to the photoreceptor drum 12 so that the toner particles 40 on the outer circumference of the roller 42 are electrostatically attracted to adhere to the latent image on the surface of the photoreceptor drum 12, whereby the latent image is rendered visible as a toner image. The toner 40 to be used in the invention is in a particulate form which is mainly composed of a coloring material such as carbon black or a pigment and a resin component. The toner is not limited to any particular type as long as it is easy to handle and capable of producing dark prints of high quality consistently for an extended period of time. The toner may be either of a one-component system or of a two-component system comprising insulating toner particles mixed with triboelectrically chargeable particles (carrier). The particle size of the toner to be used in the invention also is not limited to any particular value but it preferably consists of fine particles having the highest possible uniformity of grain size.

The method of developing the electrostatic latent image on the surface of the photoreceptor drum 12 also is not limited to the illustrated case of employing the toner developer and any known development processes may be employed, typical examples of which include: two-component development techniques utilizing triboelectrification such as cascade development, magnetic-brush development fur brush development, pressure-roller development and microtoning; one-component development techniques also utilizing triboelectrification such as induction charging development with an electrically conductive magnetic toner, as well as insulating toner developments such as impression development, jumping development and BMP (bipolar magnetic toner) development; and aerosol development techniques such as powder-cloud development and mist development which use air or a mist as the carrier.

The transfer means 20 strips the toner image from the photoconductor layer on the surface of the photoreceptor drum 12 and transfers it on to the toner image support 43 such as an image-receiving paper or film. The transfer means 20 comprises an endless conductive belt 44 and three rollers 45 for holding it in a stretched condition. The belt 44 is supplied with a specified dc voltage opposite in polarity to the charge on the toner particles 40 and holds the image support 43 on to the rotating photoreceptor drum 12 as the image-receiving surface is urged against its outer circumference at a specified pressure. In order to charge the image support 43 in a polarity opposite to the charge on the toner particles 40, the conductive belt 44 is supplied with a specified dc voltage opposite in polarity to the charge on said toner particles 40 and the method of doing this is not limited in any particular way and any known methods and means may be employed, as exemplified by designing the three rollers 45 as insulating rollers, which are brought into contact with the conductive belt 44 to apply a voltage of the desired polarity directly. Alternatively, one of the three rollers 45 for holding the conductive belt 44 in a stretched condition is adapted as a conductive roller, which is supplied with a voltage of the desired polarity.

The method the transfer means 20 employs to transfer the toner image in the invention is by no means limited to the use of the conductive belt in combination with rollers as in the illustrated case and any other means and methods may be employed as long as they can charge the image support 43 in a polarity opposite to the charge on the toner particles 40. One example of such alternatives is bias roller transfer, in which the conductive belt 44 is not used but a dc voltage of the desired polarity and a pressure are applied to conductive rollers while the image support 43 is transported as it is held between the photoreceptor drum 12 and the conductive rollers. Another possible approach is corona discharge transfer using a corotron.

The eraser 21 and the cleaning means 22 are devices for cleaning the outer circumference of the photoreceptor drum 12 by removing the residual toner from the photoconductor layer. Specifically, the eraser 21 erases the charges on the photoreceptor drum 12 and the residual toner so as to attenuate their adhesion (e.g. by coulombic forces) prior to the removal of the residual toner and to this end, known means and methods may be employed such as a corotron for effecting corona discharge or a lamp for performing illumination with light. The cleaning means 22 is a physical means of removing the residual toner from the outer circumference of the photoreceptor drum 12 and it may be of any types that will neither damage the photoconductor layer on the outer circumference of the photoreceptor drum 12 nor deteriorate its characteristics. A suitable type may be selected from among known cleaning means and methods including: contact removing means such as a brush, particularly a fur brush, a blade, particularly a doctor blade, a web and a roll; non-contact removing means which employs an air jet or ultrasonic waves; and contact removing means enhanced by electrostatic forces as exemplified by a magnetic brush or bias brush. The choice of a suitable cleaning means or method depends on the mechanical strength and other characteristics of the photoconductor layer on the outer circumference of the photoreceptor drum 12.

The final image support feed section 24 supplies the final image support 43 such as an image-receiving paper or film to the toner-image carrying photoreceptor drum 12 and the transfer means 20 and comprises a magazine 46 containing a plurality of cut sheets of image support 43, a withdrawing roller 47 for sheet-feeding the image supports 43 from the magazine 46 and a nip roller pair 48 for holding and transporting the sheet-fed image support 43 to the photoreceptor drum 12 and the transfer means 20. The construction of the final image support feed section 24 and the means and method of supplying the final image support 43 are not limited in any particular way; in an alternative case, a roll (uncut length) of image support may be supplied either as it is or after being cut to a specified size.

The fixing means 26 fuses the toner image transferred on to the final image support and allows it to solidify such that it is fixed. In the illustrated case, the fixing means 26 comprises a hot roller pair 49 having at least one hot roller and which is provided in the transport path on the exit side of the transfer means 20. Generally, the fixing means 26 is such that the toner image transferred on to the final image support is subjected to heat or pressure or otherwise treated, for example, with a solvent, whereby the toner particles are fused or melted to coalesce together to form a melt which wets and adheres to the surface of the image support 43 such as an image-receiving film or paper (if the image-receiving surface of the support 43 has asperities as in the case of paper, the melt will fill the recesses), with the supply of heat, pressure or the solvent to the toner particles being then stopped to have the toner image solidify on the support 43, whereupon its fixing is complete. Therefore, the fixing means 26 to be used in the invention is by no means limited to the illustrated hot roller pair 49 and any device that has the above-described fixing action will do, as exemplified by various known fixing methods and means, including other hot roller fixing means (or methods), thermal fixing means (or methods) such as an infrared lamp or a xenon flash lamp, pressure fixing means (or methods) and solvent fixing means (or methods).

If the image support 43 has a smooth image-receiving surface as in the case of an image-receiving film, the smooth surface is preferably roughened prior to the fixing step or, alternatively, the toner particles may be so adapted that their melt will provide enhanced adhesion.

The ejecting section 28 is where the final image support to which the toner image has been fixed by the fixing means 26 is ejected from the apparatus and it comprises an ejecting roller pair 50 which holds and transports a hard copy to be ejected from the apparatus, said hard copy comprising the image support 43 to which the toner image has been fixed by means of the hot roller pair 49 and which has subsequently been transported to the ejecting section 28, and a tray 51 for receiving the hard copies as they are successively ejected from the apparatus by means of the roller pair 50. Needless to say, the ejecting section 28 is by no means limited to the illustrated case.

The most characterizing portion of the present invention is that using the illustrated image recording apparatus 10, a plurality of toner images formed of the same toner are transferred on to the same final image support 43 so as to reproduce a single image in hard copy. On the pages that follow, the features of the illustrated image recording apparatus 10 that are required to materialize the characterizing portion of the invention will be described in greater detail.

To begin with, the image signal processor 36 associated with the exposing means 16 has such a capability that the image data required to perform one cycle of toner image formation is generated on the basis of both the density of the image in hard copy which is to be reproduced on the final image support 43 and the number of toner images to be transferred on to the same support 43.

Figure 3A:
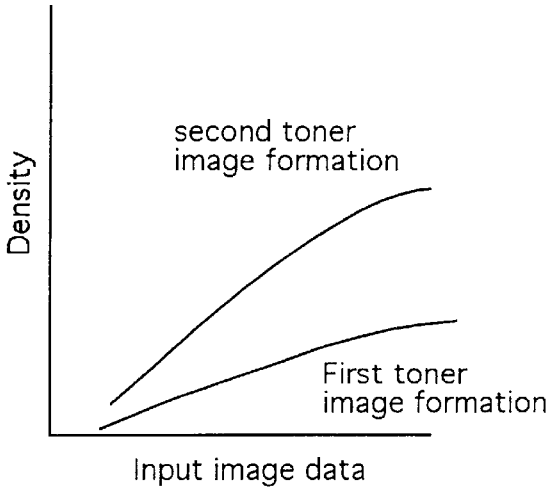
FIGS. 3A and 3B are graphs showing two different effects of the invention.

If desired, the image data required to perform one cycle of toner image formation which is generated in the image signal processor 36 may be identical in successive cycles of toner image formation. In this case, not only the contrast (gradient) but also the maximum density of the reproduced image can be increased as shown in FIG. 3A.

Figure 3B:
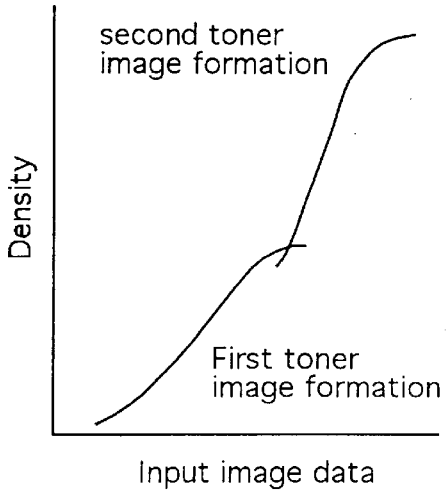

Alternatively, the image signal processor 36 may be so adapted as to generate image data for the first cycle of toner image formation, the second cycle and so forth depending on the density of a specific area of the image to be reproduced. Briefly, only a few transfer operations are performed in the image area which is to be reproduced at the lower density whereas more transfers are effected in the image area to be reproduced at the higher density. In this case, the maximum density of the reproduced image can be increased without significantly changing its contrast (gradient) as shown in FIG. 3B.

In the multiple toner image formation, the toner images to be formed in succession may be varied in resolution. The method of varying the resolution from one toner image to another is not limited in any particular way and various known techniques may be employed, as exemplified by forming toner images with the scan pitch, recording density, the number of screen lines, the dot density and the like being changed as appropriate. The representation of image density in the invention is not limited in any particular way and any known technique may be employed. In the case under consideration, the relevant image data, the speed of main scanning with the light deflector 33 and the speed of auxiliary scanning with the photoreceptor drum 12 are generated and these data are used to perform imagewise exposure by the exposing means 16 and the resulting latent image is developed with a toner such that toner images of different resolutions are formed in successive cycles. Needless to say, the motors for driving the light deflector 33 and the photoreceptor drum 12 should be controlled such that they rotate at appropriate speeds.

As described above, multiple toner image formation is effected in the invention either using the same image data or dividing the reproduced image into different-density areas or changing the resolution; this contributes to increase the maximal density of the reproduced image such that it will have a sufficient contrast range, for example, the 10-bit contrast required by images to be used in medical diagnoses. Hence, the reproduced image obtained in the invention has high quality as evidenced by sufficiently high maximal density to assure high contrast.

It is also required by the invention that after a toner image has been transferred from the photoreceptor drum 12 on to the image support 43, another toner image should be transferred from the photoreceptor drum 12. To this end, the toner image carrying support 43 which has been or yet to be ejected onto the tray 51 in the ejecting section 28 is moved in reverse direction either by appropriately adapted transport means in the transfer means 20 and the feed section 24 or in an entirely separate reverse transport path such that the support 43 is automatically replaced in the magazine 46 in the feed section 24. Alternatively, a standby section or an intermediate tray where the toner image carrying support 43 which has been moved in reverse direction is put in a standby position may be provided either in the transport path between the transfer means 20 and the feed section 24 or in a transport path connected to said transport path or in the above-described entirely separate reverse transport path. The toner image carrying support 43 may be moved in reverse direction before or after the transferred image is fixed by the fixing means 26 but it goes without saying that if the reverse movement of the support 43 precedes the fixing step, the transferred image must eventually be fixed.

The foregoing describes the basic features of the image recording method according to the first embodiment of the invention, in which the latent image formed on the surface of a single electrophotographic photoreceptor using a single light beam is developed with a single type of toner and the process is repeated several times to produce a single image in hard copy, as well as the image recording apparatus 10 for implementing the method.

Figure 4:
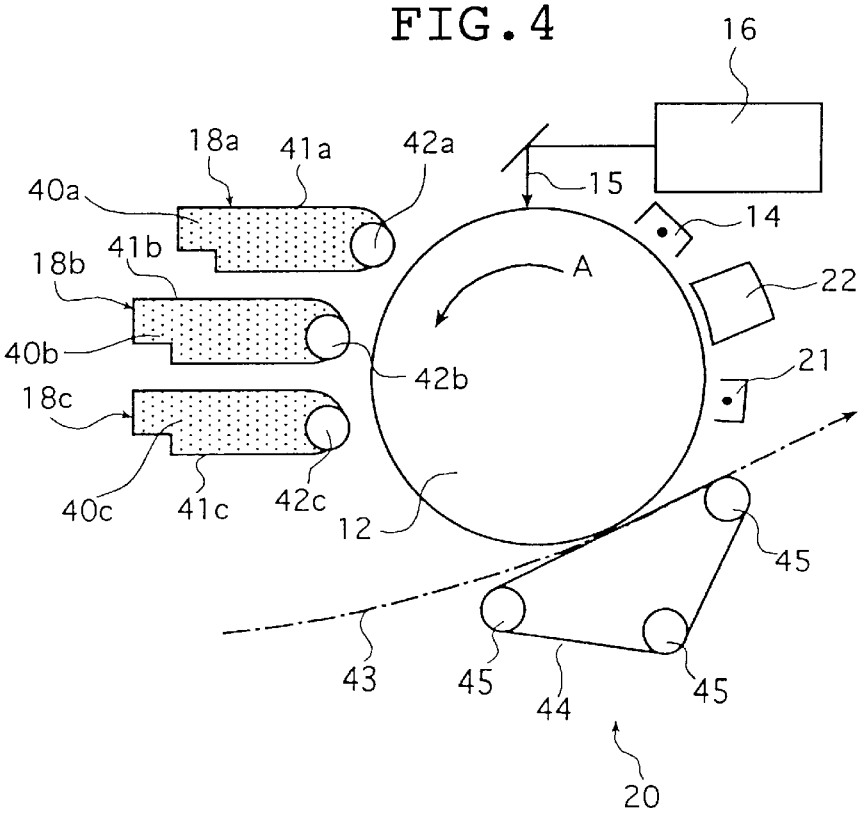
FIG. 4 is a simplified schematic view of another exemplary image recording apparatus for implementing the image recording method of the invention.

FIG. 4 shows an exemplary image recording apparatus for implementing the image recording method according to the second embodiment of the invention, in which the latent image formed on the surface of a single electrophotographic photoreceptor using a single light beam is developed with multiple (in the illustrated case, three) toners of the same color and the process is repeated several times to produce a single image in hard copy.

The image recording apparatus generally indicated by 60 in FIG. 4 is completely identical to the image recording apparatus 10 of FIG. 1, except that more than one toner developer is used and that the feed section 24, the fixing means 26 and the ejecting section 28 are not shown; therefore, like components are identified by like numerals and will not be described in detail. Needless to say, the feed section 24, the fixing means 26 and the ejecting section 28 which are not shown in FIG. 4 are incorporated in the actual unit of the image recording apparatus 60.

The image recording apparatus 60 shown in FIG. 4 has three toner developers 18*a*, 18*b* and 18*c* which respectively have containers 41*a*, 41*b* and 41*c* of toners 40*a*, 40*b* and 40*c*, as well as developing rollers 42*a*, 42*b* and 42*c*. If the toners 40*a*, 40*b* and 40*c* in the three toner developers 18*a*, 18*b* and 18*c* are of the same type, image recording according to the first embodiment of the invention can be accomplished. On the other hand, if the toners 40*a*, 40*b* and 40*c* in the three toner developers have the same color but are different in composition, the degree of freedom in the representation of contrast in image reproduction can be increased to produce even higher-density and quality images.

For example, the toners 40*a*, 40*b* and 40*c* may be adapted to have the same color but different particle sizes (diameters). If it is anticipated that the smaller toner particles alone give a too contrasty image or a too hard gradation image, the larger toner particles are deposited in a comparatively low density and the smaller ones in high density, thereby giving a lower contrast or a softer gradation while preventing the deterioration of graininess which would otherwise occur if the larger toner particles were exclusively used. As a result, a balance is maintained between contrast and graininess to provide improved image quality. Needless to say, not only the particle size but also the toner composition may be varied in toners 40*a*, 40*b* and 40*c* as long as they have the same color.

The toners 40*a*, 40*b* and 40*c* may be adapted to have different optical densities. Thus, toner image quality can be also improved through contrast adjustment.

The illustrated image recording apparatus 60 has three toner developers 18*a*, 18*b* and 18*c*. However, the number of toner developers is not critical and may be less or more than three. In addition, the toners to be contained in the developers may be varied in any number of sizes, compositions or optical densities.

Having described the basic construction of the image recording method according to the second embodiment of the invention and the apparatus for implementing it, we proceed to the third embodiment of the invention.

Figure 5:
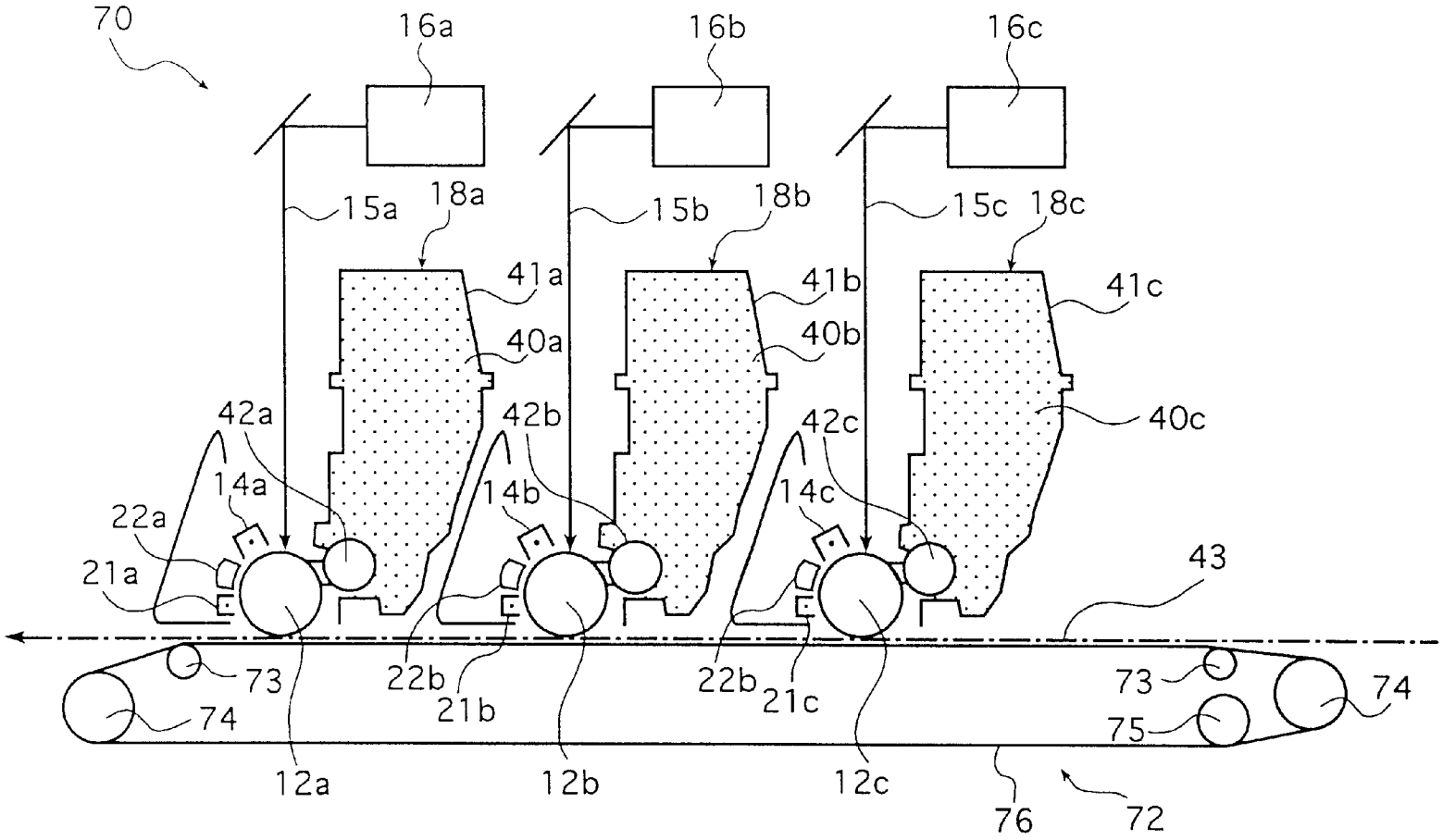
FIG. 5 is a simplified schematic view of yet another exemplary image recording apparatus for implementing the image recording method of the invention.

FIG. 5 shows an exemplary image recording apparatus for implementing the image recording method according to the third embodiment, in which the latent images formed on multiple (three) electrophotographic photoreceptors using multiple (three) light beams are developed with multiple (three) toners of the same color and the process is repeated several times to produce a single image in hard copy.

Aside from the difference in size, the image recording apparatus generally indicated by 70 in FIG. 5 is essentially the same as the apparatus 10 of FIG. 1, except that three of a structural unit excluding the transfer means 20, feed section 24, fixing means 26 and ejecting section 28 are arranged in parallel to share the transfer means 20. Since the two apparatus are completely identical in the other aspects, like components are identified by like numerals and will not be described in detail. Needless to say, the image recording apparatus 70 of FIG. 5 is actually fitted with the feed section 24, fixing means 26 and ejecting section 28 although they are not shown in FIG. 5.

The image recording apparatus 70 of FIG. 5 has three photoreceptor drums 12*a*, 12*b* and 12*c* and accordingly three sets of corona charging devices 14*a*, 14*b* and 14*c*, exposing means 16*a*, 16*b* and 16*c* for issuing light beams 15*a*, 15*b* and 15*c*, respectively, toner developers 18*a*, 18*b* and 18*c*, erasers 21*a*, 21*b* and 21*c*, and cleaning means 22*a*, 22*b* and 22*c*; these components in three sets are arranged on the outer circumferences of the respective photoreceptor drums. The three units share the transfer means 72 which comprises a pair of transport rollers 74 provided at opposite ends, an endless conductive belt 76 stretched between the transport rollers 74, two tension rollers 73 provided inward of the transport rollers 74 to adjust the force by which the endless belt 76 is urged against the three photoreceptor drums 12*a*, 12*b* and 12*c*, and a conductive rollers 75 for applying a specified dc voltage to the conductive belt 76.

By using the same toner or multiple toners of the same color but in different sizes or compositions, the image recording apparatus 70 of FIG. 5 can implement the image recording method according to either the first or the second embodiment of the invention in the same manner, except that the processing speed is faster than is achievable by the corresponding apparatus 10 or 60.

The transfer means to be employed in the image recording apparatus 70 for implementing the third embodiment is in no way limited to the type indicated by 72 in FIG. 5 and as in the case of the transfer means 20 shown in FIGS. 1 and 4, any other known transfer means and methods may of course be employed.

While the image recording method of the present invention has been described above in detail, it should be noted that the invention is in no way limited to the illustrated embodiments and various modifications and improvements can of course be made without departing from the spirit and scope of the invention.

As described on the foregoing pages, the present invention, when applied to image recording by a dry electrophotographic system, can provide a sufficiently high (e.g. up to about 3.0) maximum density, as well as a satisfactorily high (e.g. up to about 10 bits) contrast, irrespective of whether the final image support is of a reflection type (e.g. paper) or a transmission type (e.g. transparent film), whereby high-quality images of high density and contrast can be reproduced in a very simple and yet positive way compared to the conventional wet system.

Another advantage of the invention is that by using toners of different compositions or particle sizes, not only the problem of deteriorated graininess in image reproduction due to the use of larger toner particles but also the problem of unduly high contrast in reproduced images and the problem of deterioration in the transfer of toner images, both being due to the use of smaller toner particles, are solved to ensure the production of images that are satisfactory in terms of graininess, contrast and transferability.

Hence, the electrophotographic images produced by the method of the invention can be applied with advantage to the field of diagnoses, particularly medical diagnoses, where images of high density, contrast and quality are required.

What is claimed is:

1. An image recording method in which toner images of the same color are formed on an electrophotographic photoreceptor by electrophotography and transferred more than once in superposition on to a single image recording medium, thereby recording a single reproduced image;

wherein said toner images to be transferred more than once are formed of different sized toner particles.

2. The image recording method according to claim 1, wherein said toner images are formed on the basis of the same image data.

3. The image recording method according to claim 1, wherein said toner images are formed in accordance with the density of a specific area of said reproduced image.

4. The image recording method according to claim 1, wherein said toner images have different resolutions.

5. The image recording method according to claim 1, wherein said toner particles have different optical densities.

6. The image recording method according to claim 1, wherein said toner images are formed as latent images on the same electrophotographic photoreceptor with a common laser light source.

7. The image recording method according to claim 1, wherein said toner images are formed as latent images on the same electrophotographic photoreceptor with different beams of laser light.

8. The image recording method according to claim 1, wherein said toner images are formed as latent images on different electrophotographic photoreceptors with different beams of laser light.

9. An image recording method, comprising:

forming toner images of the same color on an electrophotographic photoreceptor by electrophotography; and transferring said images more than once in superposition onto a single image recording medium to provide a single reproduced image;

wherein said toner images formed of said same color are formed of toner particles having different optical densities.

10. The image recording method according to claim 9, wherein said toner images are formed on the basis of the same image data.

11. The image recording method according to claim 9, wherein said toner images are formed in accordance with the density of a specific area of said reproduced image.

12. The image recording method according to claim 9, wherein said toner images have different resolutions.

13. The image recording method according to claim 9, wherein said toner images are formed as latent images on the same electrophotographic photoreceptor with a common laser light source and developed with the same toner.

14. The image recording method according to claim 9, wherein said toner images are formed as latent images on the same electrophotographic photoreceptor with different beams of laser light.

15. The image recording method according to claim 9, wherein said toner images are formed as latent images on different electrophotographic photoreceptors with different beam of laser light.

* * * * *